US007934403B2

(12) United States Patent
Cho et al.

(10) Patent No.: US 7,934,403 B2
(45) Date of Patent: May 3, 2011

(54) DISPENSER OF DETERGENT SUPPLY APPARATUS FOR WASHING MACHINE

(75) Inventors: Han Ki Cho, Changwon-si (KR); Yang Hwan No, Changwon-si (KR); Jung Hoon Kang, Changwon-si (KR); Jong Min Kim, Changwon-si (KR); Ho Sung Jang, Kyungsangnam-do (KR); Dong Hoon Kang, Pusan (KR)

(73) Assignee: LG Electronics Inc., Seoul (KR)

( * ) Notice: Subject to any disclaimer, the term of this patent is extended or adjusted under 35 U.S.C. 154(b) by 845 days.

(21) Appl. No.: 11/104,449

(22) Filed: Apr. 13, 2005

(65) Prior Publication Data

US 2005/0235703 A1 Oct. 27, 2005

(30) Foreign Application Priority Data

Apr. 14, 2004 (KR) ..... 10-2004-0025969

(51) Int. Cl.
*D06F 35/00* (2006.01)

(52) U.S. Cl. ..... 68/17 R; 68/147

(58) Field of Classification Search ..... 68/17 R; 137/268

See application file for complete search history.

(56) References Cited

FOREIGN PATENT DOCUMENTS

| | | | |
|---|---|---|---|
| DE | 195 35 203 | * | 10/1996 |
| DE | 195 35 203 C1 | | 10/1996 |
| EP | 0 318 070 A1 | | 5/1989 |
| EP | 0 331 920 A2 | | 9/1989 |
| EP | 0 913 514 | * | 5/1999 |

OTHER PUBLICATIONS

Your Dictionary.com, Defination of Slit.*

* cited by examiner

*Primary Examiner* — Michael Kornakov
*Assistant Examiner* — Eric Golightly
(74) *Attorney, Agent, or Firm* — Birch, Stewart, Kolasch & Birch, LLP

(57) ABSTRACT

The present invention provides a dispenser which evenly dispenses washing water to a detergent container. Within the dispenser, a slit of a subsidiary water passage is configured in a rib located between an inlet water passage where washing water enters the dispenser and an end water passage distant from the inlet water passage by the farthest. Some quantity of washing water running the inlet water passage is diverged and moves to the end water passage where washing water has been insufficiently supplied. Hereby, washing water is equally scattered over the dispenser and drops into the detergent container. The dissolving power can be much more enhanced.

13 Claims, 7 Drawing Sheets

DISPENSER OF DETERGENT SUPPLY APPARATUS FOR WASHING MACHINE

BACKGROUND OF THE INVENTION

1. Filed of the Invention

The present invention relates to a dispenser of a detergent supply apparatus for a washing machine, more particularly, which is capable of dispensing washing water fed from a water supplier, by being widely scattered over a detergent container. With that, washing water and detergent can be efficiently mixed, and be supplied to a tub of the washing machine.

2. Description of the Related Art

FIG. 1 shows a detergent supply apparatus of a washing machine based on the prior art, and FIG. 2 shows a dispenser based on the prior art.

The detergent supply apparatus of the washing machine comprises a detergent container 2 which stores detergent, a housing 1 mounted in a cabinet assembly 8, and a dispenser 3 installed in a top portion of the housing 1 to dispense washing water supplied from a water supplier to the detergent container 2 (see FIG. 1).

The detergent container 2 which stores detergent, bleach or fabric softner is inserted into the housing 1 to move forward. Detergent, bleach or fabric softner in the detergent container 2 is diluted by washing water supplied from the dispenser 3, and is supplied to a tub of the washing machine.

The dispenser 3 comprises a top cover 5 and a bottom cover 4. Those edges are assembled by melting bond. Washing water flowed in the dispenser 3 is supplied to the detergent container 2 through a plurality of holes 6 configured on the bottom cover 4 (see FIG. 2)

A water passage 9 is configured in the bottom cover 4 due to an upwardly protruded rib 7 that helps washing water from the water supplier to be efficiently dispensed and be dropped toward the detergent container 2. The water passage 9 is made to turn around several times, so as to take up much space of the bottom cover 4.

The water passage 9 includes an inlet water passage 10 where washing water enters the dispenser 3 and goes ahead without changing its direction, and a turning water passage 12 where washing water through the inlet water passage 10 changes its direction and flows.

In case a plurality of turning water passages 12 are configured in the water passage 9, if the pressure of washing water through the inlet water passage 10 is not that high, the water pressure gets lowered while washing water moves. It results that washing water does not smoothly flow up to an end water passage 14 situated in an end of the water passage 9.

After all, the conventional dispenser for the washing machine has a problem that washing water is not dispensed to the end water passage 14, thus, detergent, fabric softner or bleach stored in the detergent container 2 does not get dissolved and diluted well.

SUMMARY OF THE INVENTION

An aspect of the present invention fulfills the foregoing needs by providing a dispenser which widely scatters washing water over an overall detergent container.

The dispenser for a washing machine having a detergent supply apparatus comprises a dispense chamber which has a plurality of holes on its bottom to supply washing water to the detergent container, and a main water passage which makes washing water entering the dispense chamber spread out the dispense chamber. The main water passage includes an inlet water passage where washing water flows into the dispense chamber and flows toward an end of the dispense chamber, a turning water passage where washing water converts its course, and an end water passage positioned in an end of the main water passage. A subsidiary water passage is configured in the inlet water passage, where some quantity of washing water flowing therein is delivered to another water passage.

The subsidiary water passage is placed between the inlet water passage and the end water passage, or between the inlet water passage and the turning water passage.

The main water passage is formed by a protruded rib and the subsidiary water passage, which means a slit, is formed as the rib is cut by predetermined distance.

The slit is inclined along a direction of washing water running the inlet water passage.

The dispense chamber includes a main dispense chamber which supplies washing water to a main detergent chamber, and a subsidiary dispense chamber which supplies washing water to a preliminary detergent chamber. The slit is only in the main detergent chamber.

The slit is formed in the rib located between the inlet water passage and the turning water passage. A guide rib is formed in order that washing water through the slit flows to the turning water passage.

The dispenser for the washing machine has the slit of the subsidiary water passage between the inlet water passage and the end water passage. Washing water through the slit is directly supplied throughout the main water passage, from the inlet water passage to the end water passage. Ultimately, washing water can be widely scattered over the detergent container.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENT

Figure 1:
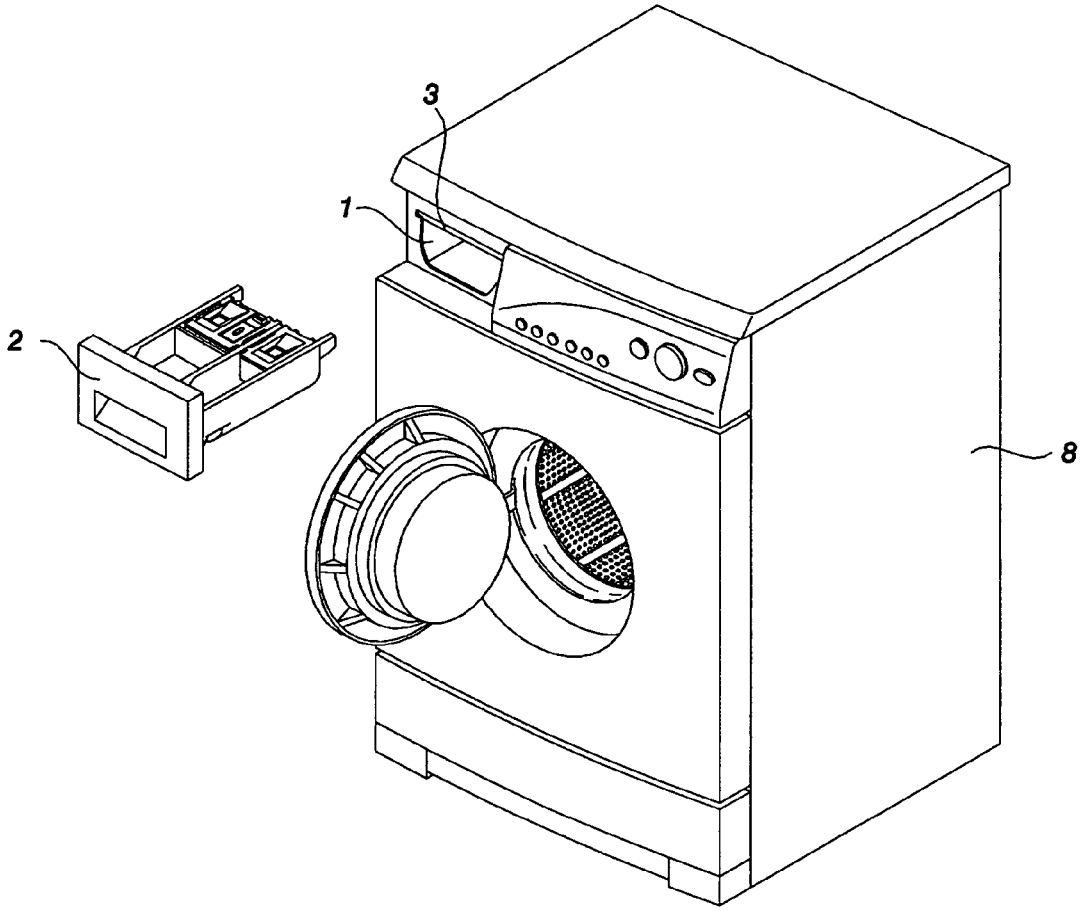
FIG. 1 (Prior Art)
FIG. 1 is an exploded perspective view of a washing machine having a detergent supply apparatus, according to the prior art.
Figure 2:
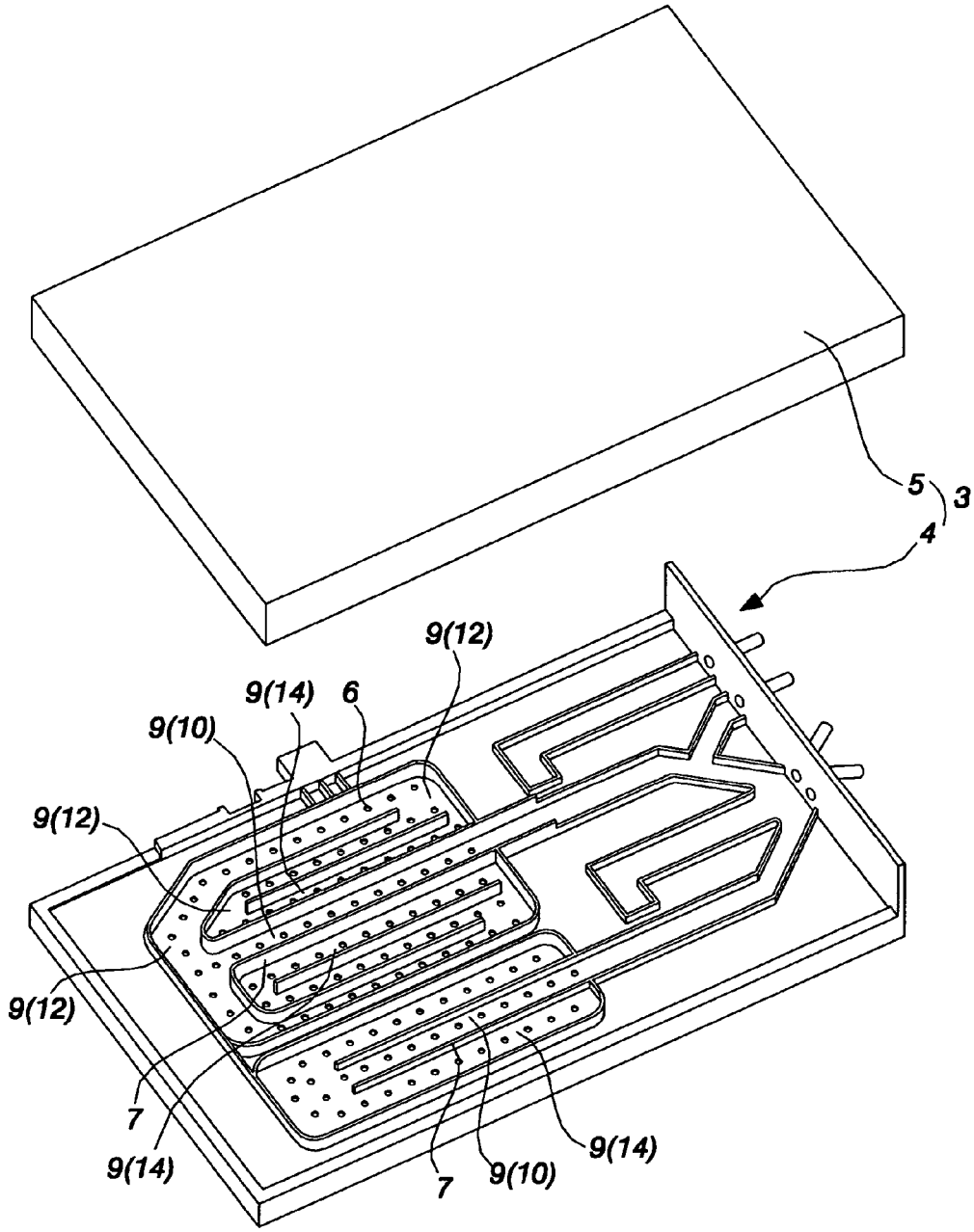
FIG. 2 (Prior Art)
FIG. 2 is a perspective view of a dispenser, according to the prior art.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
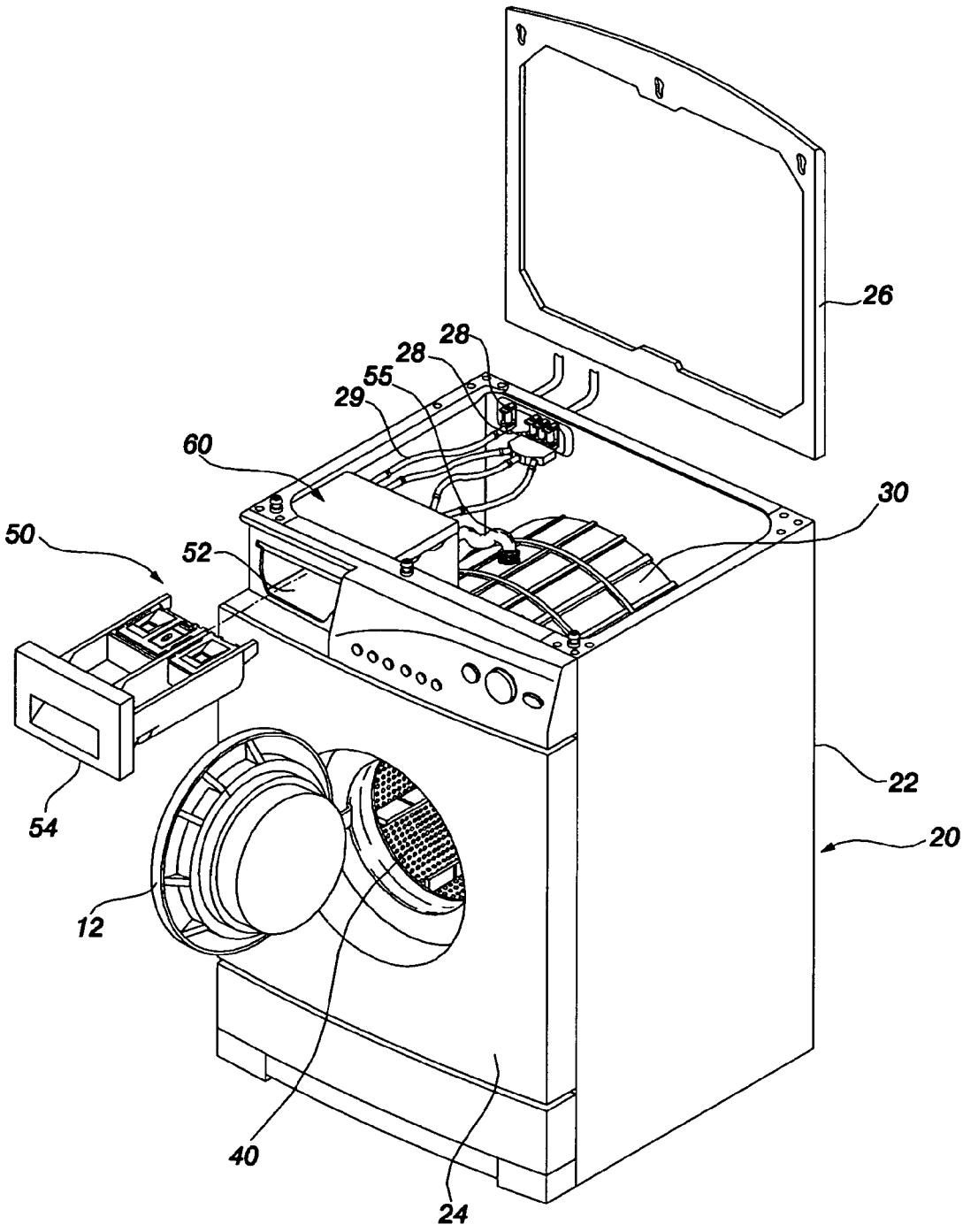
FIG. 3 is an exploded perspective view of a drum-type washing machine having the dispenser of the detergent supply apparatus, according to the embodiment of the present invention.
Figure 4:
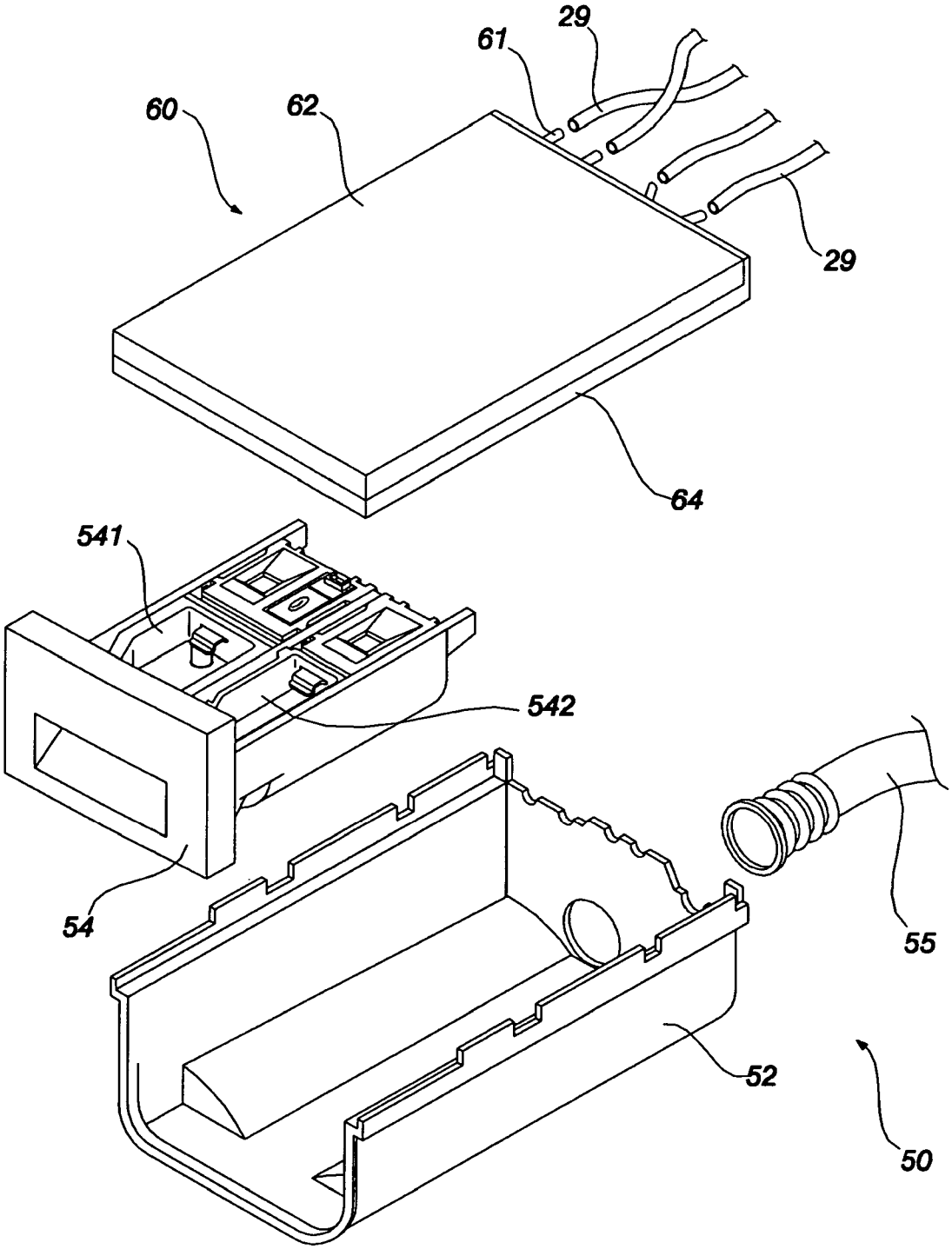
FIG. 4 is an exploded perspective view of the detergent supply apparatus having the dispenser, according to the embodiment of the present invention.
Figure 5:
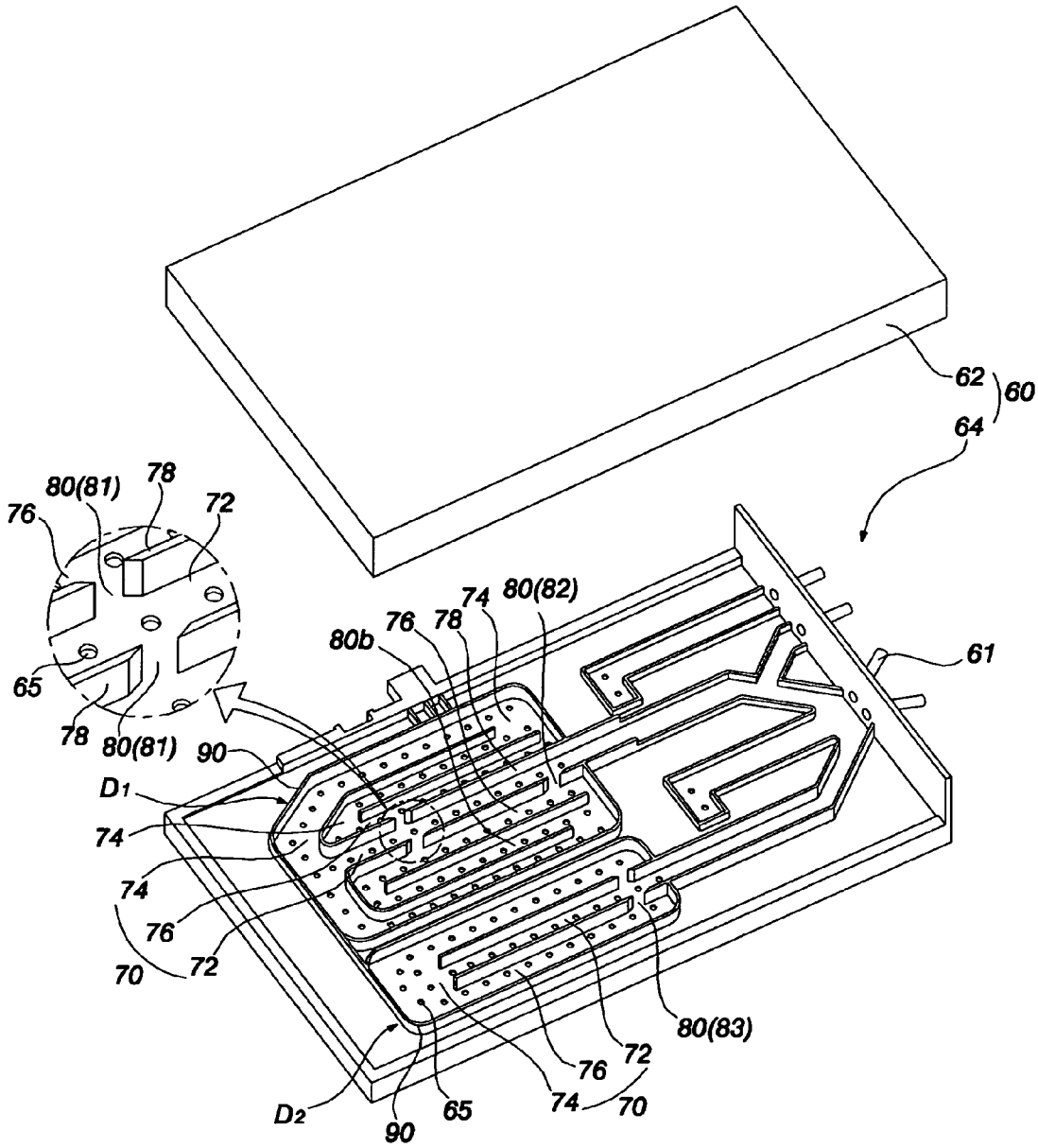
FIG. 5 is an exploded perspective view of the dispenser, according to the $1^{st}$ embodiment of the present invention.
Figure 6:
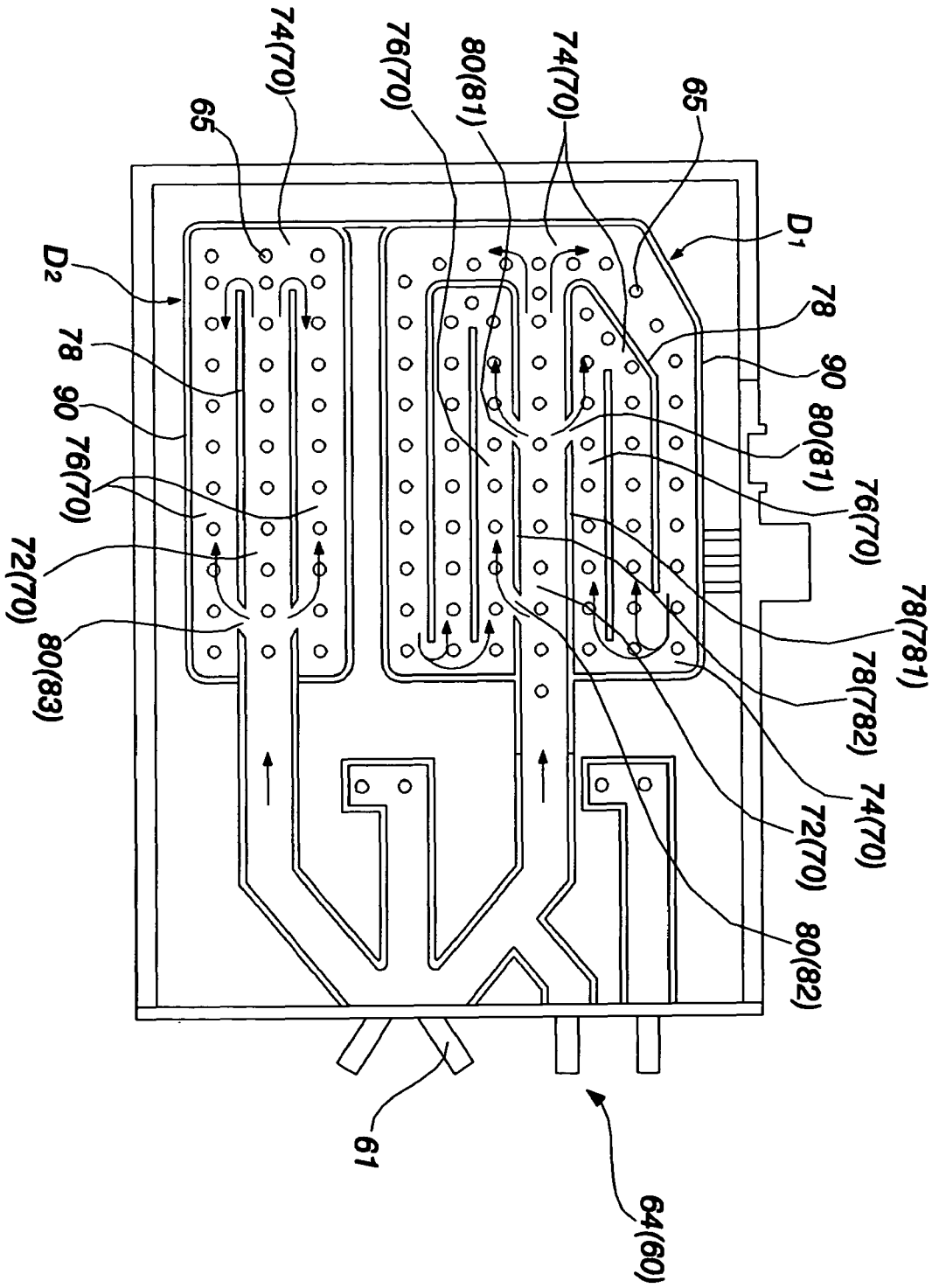
FIG. 6 is a plane view of a bottom cover of the dispenser illustrated in FIG. 5.

FIG. 3 shows a drum-type washing machine having a dispenser of a detergent supply apparatus, according to the embodiment of the present invention. FIG. 4 shows the detergent supply apparatus having the dispenser, according to the embodiment of the present invention. FIG. 5 shows the dispenser, according to the 1$^{st}$ embodiment of the present invention. And, FIG. 6 shows a bottom cover of the dispenser, according to the 1$^{st}$ embodiment of the present invention.

As seen in FIG. 3, the drum-type washing machine having the dispenser based on the embodiment of the present invention comprises a cabinet assembly 20 which defines an outer appearance of the washing machine, a tub 30 provided in the cabinet assembly 20 to contain washing water, a drum 40 rotatably set in the tub 30, a motor (not shown) connected to the drum 40 to drive the drum 40 rotating, and the detergent supply apparatus 50 installed in a top end of the cabinet assembly 20.

The cabinet assembly 20 includes a cabinet 22 which makes both sides and a rear of the drum-type washing machine, a front cover 24 mounted on a front of the cabinet 22, and a top cover 26 mounted on a top of the cabinet 22.

A water supply valve 28 and a water supply hose 29 are set in an inner side of the cabinet 22, so as to supply washing water to the detergent supply apparatus 50.

The detergent supply apparatus 50, as referring to FIG. 3 or 4, comprises a housing 52 located in the cabinet 22, the dispenser 60 located in a top of the housing 52 and connected to the water supply hose 29 to receive washing water, and a detergent container 54 movably set in the housing 52.

The detergent container 54 which stores detergent, fabric softner or bleach is partitioned into a main detergent storing section 541 for main washing, and a preliminary detergent storing section 542 for preliminary washing.

Washing water got through the housing 52 is supplied to the tub 30 by a bellow hose 55.

The dispenser, as referring to FIG. 4 or 5, comprises a top cover 62 and a bottom cover 64. The bottom cover 64 includes a tube 61 which meets the water supply hose 29. As the top cover 62 and the bottom cover 64 are assembled by melting bond, washing water fed from the tube 61 does not outflow through a crack between those covers.

A water passage is configured in at least one of the covers, where water through the tube 61 is dispersed over the detergent container 54 and is dropped. As an example, the water passage configured in the bottom cover 64 is described in the present invention.

The structure of the water passage configured in the bottom cover 64 is described below.

The bottom cover 64 is partitioned into a main dispense chamber D1 which supplies washing water to the main detergent storing section 541, and a preliminary dispense chamber D2 which supplies washing water to the preliminary detergent storing section 542. The main dispense chamber D1 and the preliminary dispense chamber D2 are segmented in the shape of a square by an upwardly protruded rib 90. A plurality of holes 65 is perforated on the dispense chambers, which makes washing water fallen to the detergent chambers 541, 542.

The dispense chambers D1, D2 include a main water passage 70 where washing water through the tube 61 is scattered over the overall dispense chambers D1, D2 and flows, and a subsidiary water passage 80 located in an end of the main water passage 70, where washing water is less supplied, to diverge washing water through the main water passage 70 and supply.

The main water passage 70 includes an inlet water passage 72 where washing water supplied from the tube 61 flows in the dispense chambers D1, D2 and flows forward, at least one turning water passage 74 where washing water moved along the main water passage 70 changes its course, and an end water passage 76 located in the end of the main water passage, where washing water passing through the turning water passage 74 arrives last.

The main water passage 70 is configured by an upwardly protruded rib 78 on the bottom cover 64.

The subsidiary water passage 80 is configured by a slit as the rib 78 that provides the main water passage 70 is cut by predetermined distance, and is placed in the rib 78 that makes the inlet water passage 72 out of the main water passage 70.

The slit of the subsidiary water passage 80, as shown in FIGS. 5 and 6, is inclined toward a direction of washing water running the inlet water passage 72. The slit penetrates the inlet water passage 72 and the end water passage 76.

As illustrated in FIG. 6, the subsidiary water passage may be configured in both ribs 781, 782 which make the inlet water passage 72, facing each other like a slit 81, or be configured in one end of the rib 782 like a slit 82.

The slit is only configured in the main dispense chamber D1 having relatively long length of the main water passage 70, and may not be configured in the subsidiary dispense chamber D2 having relatively short length of the main water passage 70.

It is appreciated that the subsidiary water passage in the main dispense chamber D1 may be optionally one slit 82 at a front portion of the inlet water passage 72, or a couple of the slits 81 at a back portion of the inlet water passage, facing each other.

One slit 82 prevents that washing water excessively flows out from the inlet water passage 72 to the end water passage 76. A couple of slits 81 supply an equal amount of washing water to a top side and a bottom side of the end water passage 76.

A flowing process with respect to washing water based on the 1$^{st}$ embodiment of the present invention will be explained in greater detail, referring to FIG. 3 or 6.

Washing water fed from the water supply valve 28 and the water supply hose 29 moves to the inlet water passage 72 through the tube 61 and flows therein. Then, some quantity of washing water transfers to the end water passage 76 by the subsidiary water passage 80, on the way that washing water keeps straight through the inlet water passage 72.

Washing water which moves straight without diverging in the subsidiary water passage 80 changes its direction at an angle of 180 degrees by the turning water passage 74. It flows to the end water passage 76 or another turning water passage 74. Washing water got in the dispense chambers D1, D2 runs along the water passage, and drops into the detergent container through the holes 65 on a bottom of the dispenser.

Washing water flowed in the end water passage 76 through the subsidiary water passage 80 collides with washing water through the turning water passage 74, and drops through the holes 65.

Figure 7:
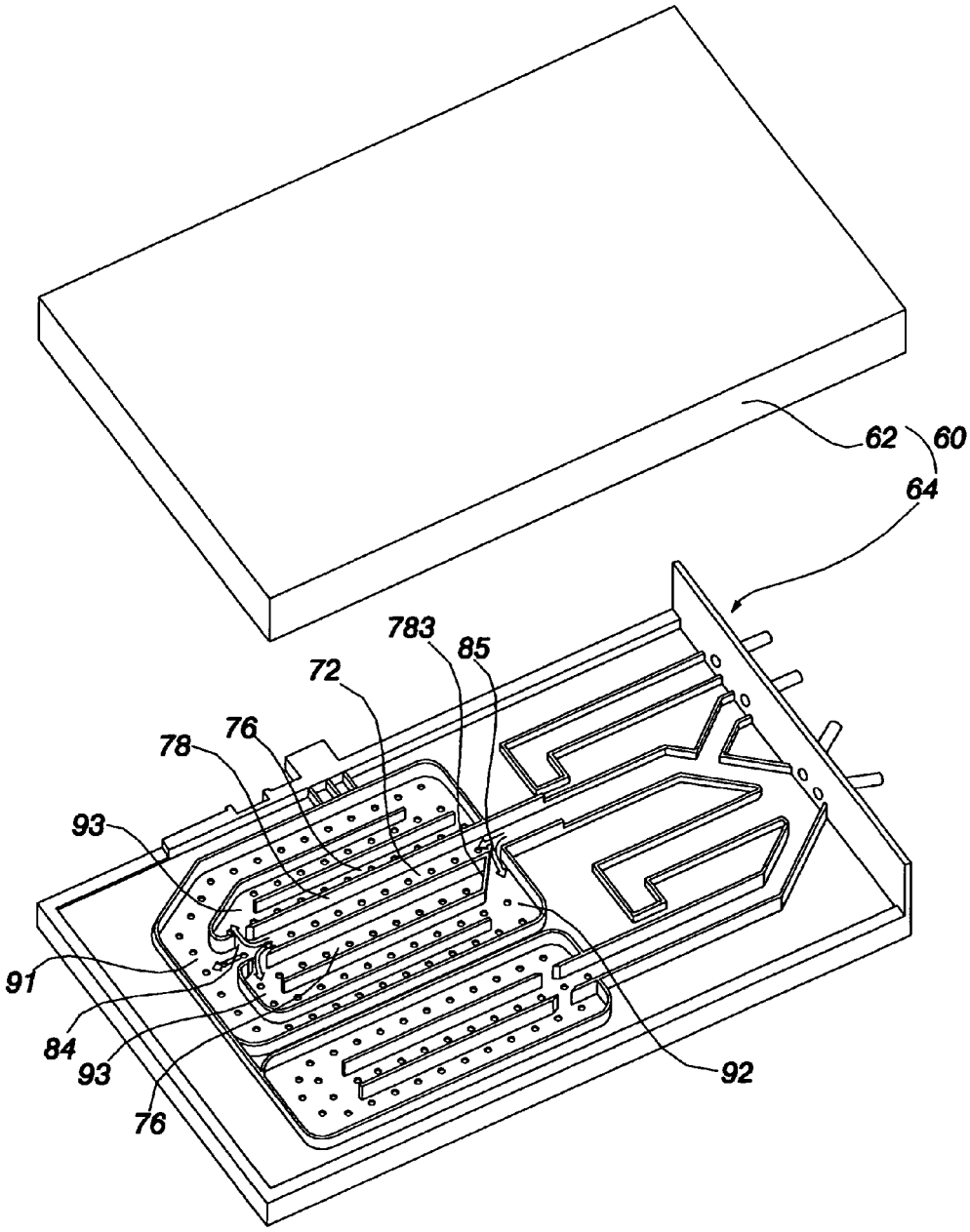
FIG. 7 is an exploded view of the dispenser, according to the $2^{nd}$ embodiment of the present invention.

FIG. 7 shows the dispenser, according to the 2$^{nd}$ embodiment of the present invention.

The subsidiary water passages 84, 85 based on the 2$^{nd}$ embodiment of the present invention make some quantity of washing water running the inlet water passage 72 supply to at least one of the turning water passages 92, 93.

The subsidiary water passages 84, 85 are configured in the rib 78 that makes the main water passage 72, so as to diverge washing water running the inlet water passage 72 and flow to the 2$^{nd}$, 3$^{rd}$ turning water passages 92, 93.

The subsidiary water passages 84, 85 are formed with the slit in the same manner as the $1^{st}$ embodiment of the present invention.

A guide rib 783 is formed around the slit 85, which makes washing water through the slit 85 flow in the $2^{nd}$ turning water passage 92, without directly flowing in the end water passage 76.

As described above, the present invention provides the dispenser having the main water passage 70 with a large quantity of washing water, and the slit of the subsidiary water passage 80 between space from the end water passage 76 or from the turning water passage 74 with a small quantity of washing water. The slit makes washing water running the main water passage diverged, and directly supplies to the end water passage 76 where washing water has not been sufficiently supplied. Washing water can be widely scattered over the bottom cover 64 of the dispenser.

Washing water equally drops through the holes 65 on the bottom cover 64 of the dispenser. Detergent in the detergent container 54 can be quickly dissolved and the solubility can be improved.

The subsidiary water passage 80 of the dispenser is inclined toward the direction of washing water. Washing water running the main water passage can be effectively diverged to the end water passage.

While the invention has been described in terms of various specific embodiments, those skilled in the art will recognize that the invention can be practiced with modification within the spirit and scope of the claims.

What is claimed is:

1. A dispenser of a detergent supply apparatus for a washing machine, comprising:

a dispense chamber including a main dispense chamber which supplies washing water to a main detergent storing section of a detergent container and a subsidiary dispense chamber which supplies washing water to a preliminary detergent storing section of the detergent container;

a main water passage formed in each of the main dispense chamber and the subsidiary dispense chamber to enable washing water flowed into the dispense chamber to flow and spread out therein, wherein each main water passage includes:

an inlet water passage where washing water flows into the dispense chamber and flows toward one side of the dispenser;

a turning water passage where washing water flowed in the dispense chamber changes direction;

an end water passage placed in an end portion of the main water passage such that washing water is supplied to the end water passage after passing through the turning water passage, the end water passage being disposed adjacent to the inlet water passage to be parallel to the inlet water passage; and a first rib upwardly protruded between the inlet water passage and the end water passage and terminating at a junction of the inlet water passage and the turning water passage, at least one first main slit formed at the first rib of the main dispense chamber to supply some quantity of washing water flowing through the inlet water passage of the main dispense chamber to the end water passage of the main dispense chamber, washing water supplied to the end water passage of the main dispense chamber flowing in a same direction as washing water supplied to the inlet water passage of the main dispense chamber; and at least one first subsidiary slit formed at the first rib of the subsidiary dispense chamber to supply some quantity of washing water flowing through the inlet water passage of the subsidiary dispense chamber to the end water passage of the subsidiary dispense chamber, washing water supplied to the end water passage of the subsidiary dispense chamber flowing in an opposite direction as washing water supplied to the inlet water passage of the subsidiary dispense chamber.

2. The dispenser of the detergent supply apparatus as set forth in claim 1, wherein the at least one first main slit is formed by cutting the first rib by a predetermined distance.

3. The dispenser of the detergent supply apparatus as set forth in claim 1, wherein the at least one first main slit is formed to be inclined toward the direction of washing water running in the inlet water passage, the at least one first main slit being formed in a straight portion of the first rib.

4. The dispenser of the detergent supply apparatus as set forth in claim 2, wherein another end water passage is placed on another portion of the main water passage, a second rib is upwardly protruded between the inlet water passage and another end water passage, and the at least one first main slit is configured in at least one of both ribs.

5. The dispenser of the detergent supply apparatus as set forth in claim 4, wherein the at least one first main slit is configured in each of the first and second ribs so as to face each other.

6. The dispenser of the detergent supply apparatus as set forth in claim 4, wherein the at least one slit is configured in each of the first and second ribs so as to be separated from each other by a predetermined distance toward the direction of washing water.

7. The dispenser of the detergent supply apparatus as set forth in claim 2, wherein the at least one first main slit is configured in a front portion of the inlet water passage.

8. The dispenser of the detergent supply apparatus as set forth in claim 2, wherein the at least one first main slit is a plurality of slits configured in a rear portion of the inlet water passage so as to face each other.

9. A dispenser of a detergent supply apparatus for a washing machine, comprising:

a dispense chamber including a main dispense chamber which supplies washing water to a main detergent storing section of a detergent container and a subsidiary dispense chamber which supplies washing water to a preliminary detergent storing section of the detergent container;

a main water passage formed in each of the main dispense chamber and the subsidiary dispense chamber to enable washing water flowed into the dispense chamber to flow and spread out therein, wherein each main water passage includes:

an inlet water passage where washing water flows into the dispense chamber and flows toward one side of the dispenser;

a turning water passage where washing water flowed in the dispense chamber changes a direction;

an end water passage placed in an end portion of the main water passage such that washing water is supplied to the end water passage after passing through the turning water passage, the end water passage being disposed adjacent to the inlet water passage to be parallel to the inlet water passage; and a first rib upwardly protruded between the inlet water passage and the end water passage and terminating at a junction of the inlet water passage and the turning water passage, at least one first main slit formed at a portion of the first rib of the main dispense chamber located between the inlet water passage and the turning water passage of the main dispense chamber; and at least one first subsidiary slit formed at a portion of the first rib of the subsidiary dispense chamber located between the inlet water passage and the end water passage of the subsidiary dispense chamber.

10. The dispenser of the detergent supply apparatus as set forth in claim 9, wherein the at least one first main slit is inclined toward the direction of washing water running along the inlet water passage.

11. The dispenser of the detergent supply apparatus as set forth in claim 9, wherein a second end water passage is placed on another portion of the main water passage, a second rib is upwardly protruded between the inlet water passage and the second end water passage, and the at least one first main slit configured in at least one of the first and second ribs.

12. The dispenser of the detergent supply apparatus as set forth in claim 11, wherein the at least one first main slit is configured in each of the first and second ribs so as to face each other.

13. The dispenser of the detergent supply apparatus as set forth in claim 11, wherein the at least one first main slit is configured in each of the first and second ribs so as to be separated from each other by a predetermined distance toward the direction of washing water.

* * * * *